United States Patent [19]

Bowler

[11] Patent Number: 4,485,951

[45] Date of Patent: Dec. 4, 1984

[54] HEEL ATTACHING MACHINE

[75] Inventor: Raymond M. Bowler, Salem, N.H.

[73] Assignee: Bush Universal, Inc., Woburn, Mass.

[21] Appl. No.: 368,566

[22] Filed: Apr. 15, 1982

[51] Int. Cl.[3] ..... A43D 79/00

[52] U.S. Cl. ..... 227/7; 29/283; 227/152; 227/153

[58] Field of Search ..... 29/283, 283.5; 227/7, 227/151, 152, 153, 154, 155, 130, 45, 48, 111, 112

[56] References Cited

U.S. PATENT DOCUMENTS 2,178,615 11/1939 Standish et al. ..... 227/152 X
2,260,466 10/1941 Lancaster ..... 227/153
3,149,341 9/1964 Senfleben ..... 29/283
3,197,106 7/1965 Clamp ..... 227/152
3,847,321 11/1974 Charlez ..... 227/153 X

*Primary Examiner*—Paul A. Bell
*Attorney, Agent, or Firm*—Wolf, Greenfield & Sacks

[57] ABSTRACT

A heel attaching machine is provided with a shoe support in the form of an elongated boot jack which is capable of handling boots as well as conventional low shoes. The machine includes a heel holddown mechanism to clamp the shoe on the support and an arrangement to withdraw the heel holddown mechanism in its entirety to a temporary, remote position which will not interfere with placement or withdrawal of a high boot on the shoe support. The machine is adapted to operate with equal facility on conventional shoes as well as high, stiff boots.

7 Claims, 8 Drawing Figures

HEEL ATTACHING MACHINE

BACKGROUND AND SUMMARY OF THE INVENTION

This invention relates to heel attaching machines and, particularly, to machines for nailing a heel onto the bottom of a shoe assembly. The machines with which the present invention is concerned include a shoe support post having a changeable nailing die supported at its upper end. The shoe assembly to which the heel is to be nailed is placed upside down, with its heel end resting on the nailing die, while the operator manually positions a heel on the shoe bottom. A heel holddown then is brought to bear downwardly on the heel, first to lightly hold the shoe and heel in proper position in readiness for the nailing operation, and then to provide a firm backup support for the heel as the nails are driven through the nailing die, upwardly through the the shoe bottom and into the heel, as guided by the nailing die. After the nailing operation, the heel holddown is withdrawn to a remote position to enable the heeled shoe to be withdrawn from the nailing die and to enable a new, unheeled shoe to be placed on the shoe jack.

Although machines of the foregoing character have been in use for many decades, they have presented some difficulties, particularly with high boots and especially with relatively stiff, high boots such as cowboy boots, riding boots or the like. Working with high boots requires use of a relatively high boot jack. However, placing a boot on or removing a boot from the long boot jack requires the boot to be raised and lowered a substantially greater height than with a conventional shoe in order to enable the boot to be placed on and taken off the boot jack. With prior heel attaching machines, the relatively large mounting and demounting movement required of boots to clear the long boot jack often requires that the boot be bent somewhat to clear the holddown. This tends to form a crease in the main portion of the boot which detracts from the appearance of the boot. Corrective operations often are required in the boot factory to remove or minimize the effect of the crease.

In accordance with the present invention, an improved arrangement is provided by which the entire holddown mechanism including the clamping elements as well as the driving elements is movable to a remote, out-of-the-way position to enable a boot to be placed on or withdrawn from the boot jack vertically and without interference from any part of the heel holddown. The present invention assures that the boot will not have to be bent or distorted when mounting or demounting, thereby avoiding the formation of unsightly creases.

More particularly, the present invention provides an arrangement for mounting the holddown actuating cylinder for movement between a normal operating position which is substantially the same as when the cylinder is rigidly attached to the machine in the presently used devices, and a raised, remote position in which the entire holddown mechanism is in an out-of-the-way location. Control means are provided to enable the holddown mechanism to be raised to the remote position, as when operating on high boots, or to maintain the holddown actuating mechanism in its normal position to operate on low shoes.

It is among the objects of the invention to provide improvements in heel nailing machines which facilitate placement and removal of a high boot in the machine without requiring undue bending or creasing of the boot during placement on and removal from the jack.

Another object of the invention is to provide improvements in heel attaching machines by which the machines may be used to nail heels onto high boots as well as low shoes.

Another object of the invention is to provide an improved holddown arrangement for the heel in a heel nailing machine in which the entire holddown mechanism, including its actuating mechanism, is retractable to a remote position which will not interfere with straight removal of high boots from the boot jack.

DESCRIPTION OF THE DRAWINGS

The foregoing and other objects and advantages of the invention will be appreciated more fully from the following further description thereof, with reference to the accompanying drawings wherein.

DESCRIPTION OF THE PREFERRED EMBODIMENT

Figure 1:
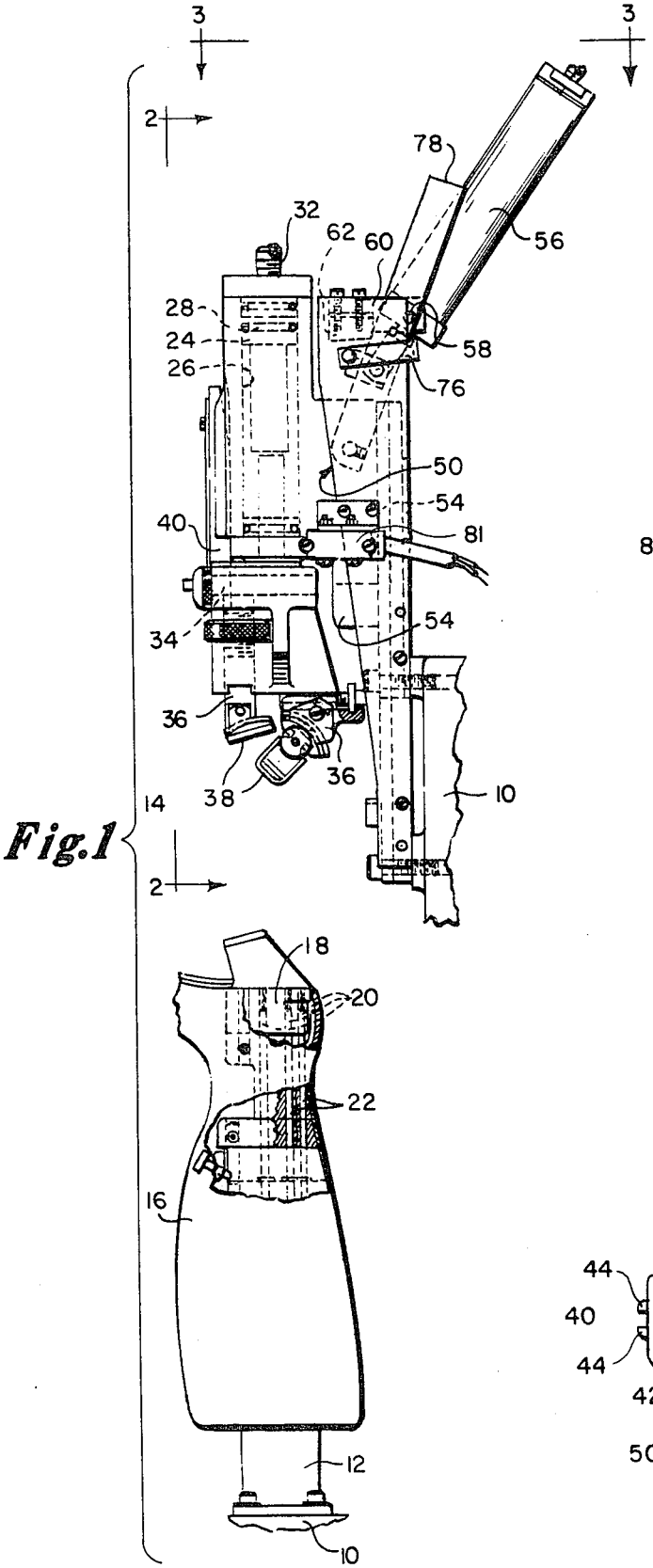
FIG. 1 is a side elevation of a portion of a heel attaching machine which incorporates the present invention and with the heel holddown mechanism in its fully raised, remote position.
Figure 2:
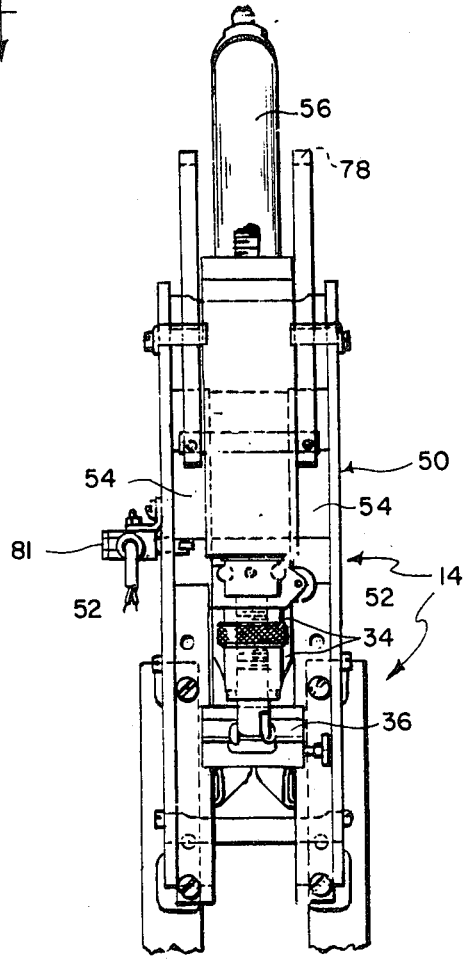
FIG. 2 is a front view of the machine as seen from the line 2—2 of FIG. 1.

As shown in the drawings, the machine includes a frame 10 to which a shoe or boot jack 12 is mounted. The frame also supports a holddown mechanism (indicated generally at 14) above the jack 12. As shown, for example, in FIG. 1, the shoe or boot 16 is placed, bottom up over the jack 12. The upper end of the jack supports a nailing die 18 which has a plurality of vertical nail passages 20, each nail passage 20 having a vertically reciprocable nail driver 22. The upper ends of the nail passages 20 are loaded with nails, points up, before the shoe or boot is loaded on the jack 12. When a shoe and heel are on the nailing die 18 and are held down firmly on the nailing die by the holddown mechanism 14, the nail drivers 20 are driven upwardly to drive the nails through the bottom of the shoe and into the heel thereby securing the heel in place on the shoe bottom. After the nails are driven, the holddown mechanism 14 retracts the holddown members to enable the shoe to be taken off the jack 12. After the shoe or boot has been removed, the machine typically will load a new set of nails into the nailing die so that the machine will be in readiness to perform the heel nailing operation on the next shoe or boot.

As mentioned above, the prior art devices present difficulties when operating on boots, particularly stiff boots which have to be bent or deformed in order to place the boot on or remove the boot from the jack, often creasing the boot. For example, U.S. Pat. No. 3,149,341 to Senfleben and U.S. Pat. No. 3,197,106 to Clamp illustrate the holddown devices which have been in common use for many years and which have presented the very difficulties which the present invention is intended to overcome.

Figure 4:
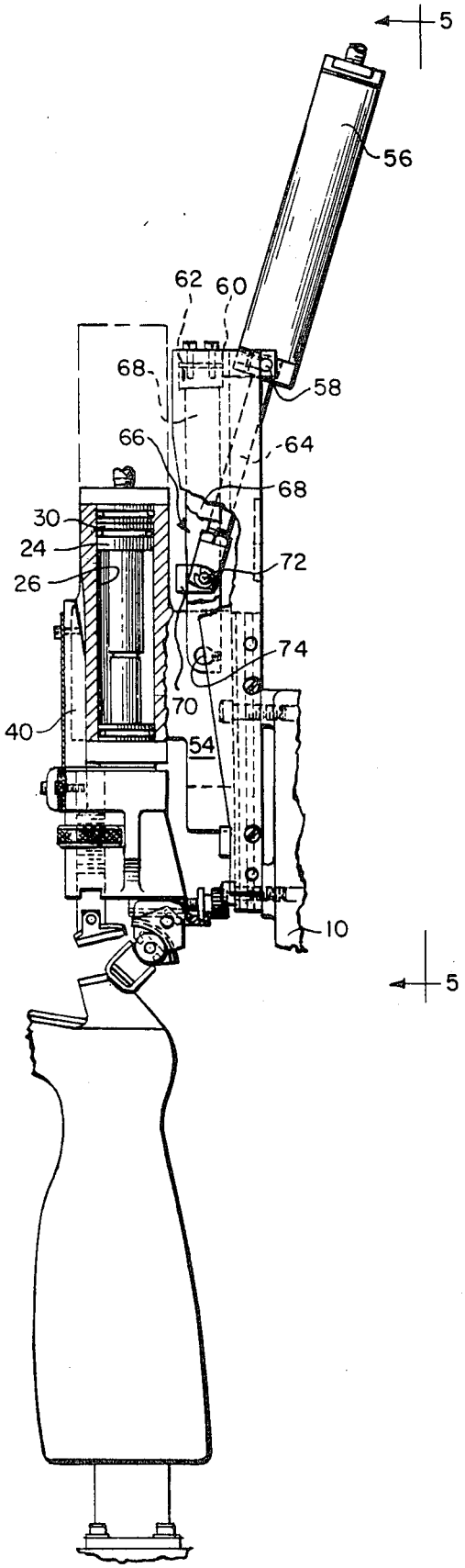
FIG. 4 is a side elevation of the machine, similar to FIG. 1, but partly broken away and illustrating the configuration of the holddown mechanism in its normal, operating position.
Figure 5:
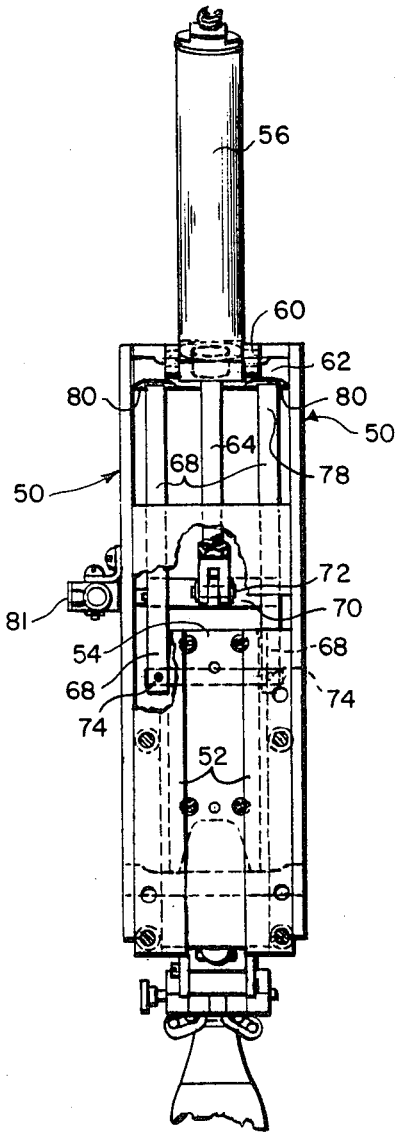
FIG. 5 is a rear elevation of the machine as seen along the line 5—5 of FIG. 4.
Figure 6:
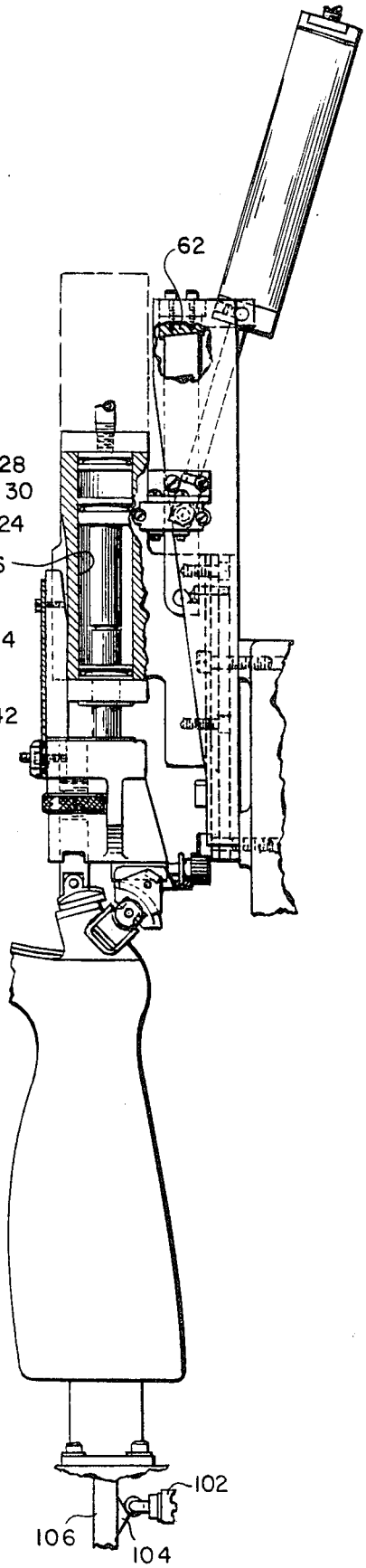
FIG. 6 is a side elevation of the machine similar to FIG. 4 illustrating the holddown with its clamp extended and in engagement with the heel of a boot.
Figure 7:
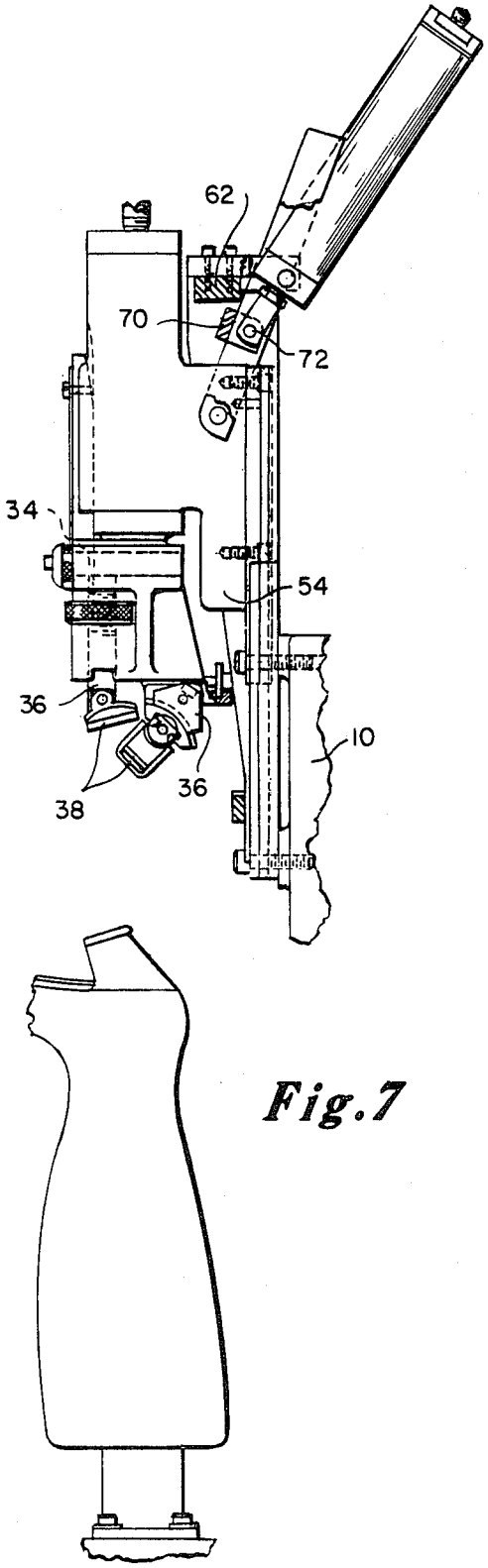
FIG. 7 is a partly broken away side elevation of the machine.

As shown in FIGS. 1, 4 and 6, the machine utilizes a holddown mechanism 14 which includes a piston and plunger 24 which is reciprocable in a cylinder 26. The upper face 28 of the piston 24 forms, with the cylinder 26, a chamber 30 (see FIGS. 4 and 6) which is connected to a source of oil or hydraulic fluid under pressure through a port 32, as will be described.

The lower end of the plunger 24 protrudes outwardly through the bottom of the cylinder 26 and is provided with an adapter 34 to which various configurations of holddown pads 38 may be detachably connected, for example, by slides 36. As described more fully in U.S. Pat. No. 3,149,341, the adapter 34 preferably is guided by a bar 40 which extends through a slot 42 in a guide flange 44 of the cylinder housing, to prevent rotation of the adapter 34 about the axis of the piston 24. The holddown pads 35 which actually engage the heel of the shoe or boot may be selected from a number of different types depending on the particular heel configuration of the shoe or boot. Typically, the holddown pad or pads 38 will be arranged to contact selected portions of the heel so that during the upward force of the nails during the nailing operation, the holddown pads 38 will provide a substantial backing force. As will be described in further detail, the piston 24 is operated first to be extended under relatively light oil pressure to bring the pads 38 into contact with the heel and, then, when the nail driving operation is to take place, the port 32 is blocked off so that the upward force of the nail driving operation can be resisted fully and only to the extent necessary. In an alternate mode of operation, high pressure oil may be directed to the cylinder to effect a high clamping force, as may be required in some instances.

Unlike the present invention, the prior machines mounted the holddown mechanism 14 in a rigid fixed position to the frame 10, as by securing the cylinder 26 to the frame 10 above the shoe or boot jack 12. In the prior machines, the piston of holddown mechanism simply was operated to extend the holddown pads 38 downwardly into engagement with the heel or to withdraw them upwardly to a position determined by the stroke of piston 24 within the cylinder 26. While the range of movement of the holddown pad 38 was satisfactory for use in connection with conventional height shoes, it would interfere with placement and removal of boots.

In accordance with the present invention, the holddown mechanism 14 is mounted for movement as a unit on the frame between a normal operating position and a raised, remote position. In the normal operating position, the holddown mechanism 14 is relatively close to the upper end of the shoe jack 12 in readiness to provide its clamping action. The clearance is such that it may operate on shoes of comparatively low, normal height. In its raised, remote position, the holddown mechanism 14 is disposed at a sufficient height so that it will not interfere with placement or removal of a high boot on the jack. As will be described, when operating on normal height shoes, means are provided to disable operation of the mechanism for shifting the position of the holddown and for locking the holddown mechanism in its normal operating position. However, when operating on high boots, the holddown mechanism is locked in its lower normal position only until a time when the heel nailing has been completed. The mechanism then shifts to its raised, remote position to move the holddown mechanism out of the way so as not to interfere with removal of the boot or placement of a subsequent boot on the jack.

The mounting arrangement for the holddown mechanism 14 includes a holddown mechanism support 50 which is secured to the frame 10. The support 50 includes vertically extending guides 52 which receive and guide a slide 54 for vertical movement. The cylinder 26 is secured integrally to the slide 54 for movement in unison with the slide. The parts of the machine are arranged so that the holddown mechanism and pads 38 will be disposed directly above the jack 12.

The holddown mechanism 14 is raised and lowered by the slide 54 by means of a pneumatically operated slide cylinder 56 which is pivotally mounted at a transverse pin 58 to the upper end of the support frame 50. The pivotal mounting for the cylinder 56 includes a bracket 60 which is secured to a cross piece 62 which is an integral portion of the support frame 50 and is located at the upper end of the support frame 50. The piston rod 64 of the slide cylinder 56 is connected to the slide 54 through an H-shaped connector 66 formed by a pair of side bars 68 connected by a transversely extending cross piece 70. The cross piece 70 is pivotally connected, at a pivot pin 72, to the piston rod 64 of slide cylinder 56. The lower ends of the side bar 68 are pivotally connected at 74 to the upper portions of the slide 54.

Figure 3:
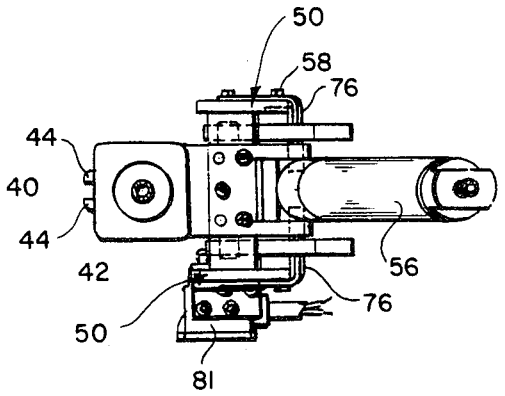
FIG. 3 is a plan view of the machine as seen from the line 3—3 of FIG. 1.

The slide cylinder 56 is operated by connection through fittings at each end of the cylinder 56 to a source of air under pressure to drive the piston rod 64 either in an upward, retracted position to raise the holddown mechanism to its upper, remote position or, alternately, to a lowered, normal operating position in which the holddown mechanism is in readiness to operate on a shoe or boot. When the cylinder 56 is in its upper retracted configuration, to hold the holddown mechanism in its remote position, the H-bar 66 is provided with a stop 76 to limit the extent to which the H-bar can swing rearwardly. (See FIGS. 1, 3)

Means are provided to assure that the holddown mechanism 14 will be disposed and locked in the same predetermined position in each instance that the cylinder 56 advances the holddown mechanism 14 to its lower position. To that end, the side bars 68 of the H-bar 66 are dimensioned with respect to the other elements of the machine so that when the slide 54 has been advanced downwardly, the upper ends 78 of the side bars 68 will just barely clear the underside 80 of the rigid, fixed upper cross piece 62. The pivot pins 72, 74 are located so that once the upper ends 78 of side bars 68 have cleared beneath the upper cross piece 62, the H-bar 66 will pivot forwardly about pin 74 under the influence of the slide cylinder 56 to urge the upper ends 78 of the H-bar 68 under the upper cross piece. The upper ends 78 of the side bars 68 are formed at a slight angle (of the order of 2° or 3°) so that they will engage the underside 80 of the upper cross piece in a manner which will cause the upper ends 78 to wedge firmly against the under surface 80. When so wedged, the side bar 68 will be disposed in substantially vertical configuration (as shown in FIGS. 4–7), thereby providing rigid and firm support for the slide 54 and holddown mechanism 14 against upward movement during operation of a nailing cycle.

A microswitch 81 is mounted on the support frame 50 at a location so as to be actuated when the side bars 68 have swung to their vertical configuration. As described below in connection with the operation description, the microswitch 81 is connected into the control circuit of the machine in a manner which precludes operation of the holddown mechanism 14 until the microswitch 81 is actuated. That insures that the holddown mechanism will not be actuable until the mechanism is in proper place by wedging of the upper end 78 of the cross piece 62.

Figure 8:
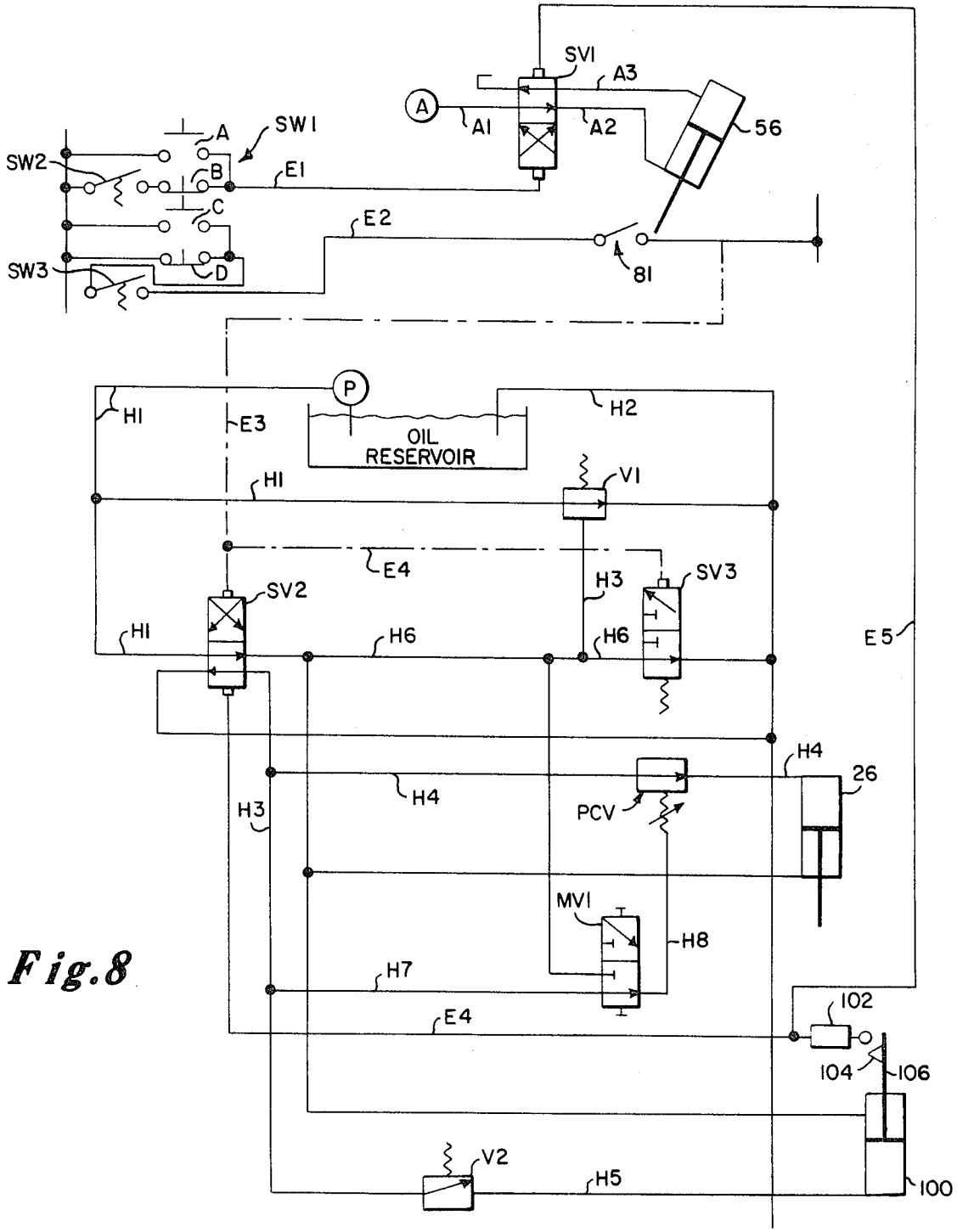
FIG. 8 is a diagrammatic illustration of portions of the control system for the machine.

The control system for operation of the invention is illustrated in FIG. 8 which is a diagrammatic illustration of the relevant portion of the pneumatic, hydraulic and electrical control circuitry of the machine. The machine includes a pressurized air source A for operation of the pneumatic slide cylinder 56, and an oil or hydraulic fluid reservoir with a pump P to develop the pressure necessary to operate the clamp cylinder 26, nail drive cylinder and other elements of the machine not described in connection this invention.

As mentioned, selector means are provided to enable the machine to be set to operate either on boots, in which case the cylinder 56 in a raised, retracted configuration or to operate on low shoes in which the cylinder 56 is in extended configuration with the slide mechanism being down. The configuration of the slide cylinder 56 is controlled by a solenoid valve SV1 which is shiftable between positions which will direct air under pressure from the source A through A1 selectively to line A2 or A3 to drive the pneumatic cylinder 56 into a retracted or extended position, respectively. Solenoid valve SV1 is set by a manual selector switch SW1 which is connected, through line E1 to one end of the solenoid valve SV1. FIG. 8 illustrates the switch SW1 set in a configuration to operate on high shank boots, in which the solenoid valve SV1 connects the air to the rod end of cylinder 56, thereby maintaining the slide in its raised configuration. In this configuration, contact pairs A and C of switch SW1 are open while contact pairs B and D are closed. In this configuration, the slide cylinder 56 is raised in readiness to be advanced downwardly after the operator has placed the boot on the boot jack and after the operator has operated the foot treadle switch SW2. When foot treadle switch SW2 is closed, it may be seen that line E1 will be in circuit, thereby shifting solenoid valve SV1 to communicate air through line A3 to the rod end of cylinder 56 while venting A2 to the atmosphere.

With the boot in place on the jack and after the operator has manually located the heel to be nailed onto the bottom of the shoe assembly, treadle switch SW2 is operated to actuate pneumatic slide cylinder 56 to bring the slide down. As described above, when the slide cylinder 56 extended to cause the H-bar 66 to swing forwardly, the H-bar will engage and close microswitch 81. Microswitch 81 is interposed in line E2 as shown in FIG. 8 so that closure of switch 81 is required in order to continue any further operating sequence of the machine. As shown, microswitch 81 is connected in series with a second foot treadle switch SW3. Upon closure of the treadle switch SW3, the circuit will be closed, thereby enabling solenoid valves SV2 and SV3 to be operated and, in turn, control operation of the clamp cylinders 26 and driver cylinders as will be described below.

When the operator is satisfied that the boot and heel are properly positioned on the jack, he then actuates treadle switch SW3 to simultaneously energize clamp solenoid valve SV2 and vent solenoid valve SV3. As described above, it is a desired feature of operation of the machine to sequence operation of the clamp cylinder 26 and drive cylinder so that the clamp cylinder first moves downwardly into engagement with the heel to hold the heel under a relatively light pressure (i.e. 125 p.s.i. oil pressure). After the operator is satisifed that the parts of the shoe are in a properly oriented, clamped configuration, the operation of the system calls for the exhaust end of clamp cylinder 26 to be blocked off by a power check valve PCV. With power check valve shifted to obstruct flow from the head end of the clamp cylinder 26, the nail drive cylinder is actuated to drive the nails upwardly into the heel but only under just that amount of force necessary. To that end, the control circuitry includes a high pressure relief valve V1 which is connected across the hydraulic line H1 and hydraulic return H2. The pressure control valve V1 is of the type which is shiftable between two venting pressures, for example, a high pressure of the order of 2,000 p.s.i. and a low pressure of the order of 75 p.s.i. Normally valve V1 is biased to vent at the lower pressure. It is actuated when pressure builds up in pilot line H3 and, when actuated, shifts to the higher pressure relief mode.

When treadle switch SW3 is switched to shift SV2, fluid under pressure will flow from line H1 through solenoid valve SV2 to the head end of clamp cylinder 26 through lines H3 and H4. Power check valve PCV interposed in line H4 and does not interfere with fluid flow in a direction toward the head end of cylinder 26. Shifting of the solenoid valve SV2 also directs the fluid to the head end of the nail drive cylinder (indicated at 100 in FIG. 8), although the operation of the nail drive cylinder 100 is delayed by the sequence valve V2 which is interposed in line H5. Valve V2 is normally maintained in a closed position and opens when pressure in line H3 has reached a predetermined value (e.g. 125 p.s.i.) above the lower pressure of valve V1 but well below the maximum relief pressure of valve V1. The foregoing arrangement assures that the nail driving operation will not take place until after the clamp cylinder is advanced downwardly and is in full and firm engagement with the heel of the shoe assembly.

It should be noted that when solenoid valve SV3 is shifted by a pulse in line E4, line H6 is blocked at SV3 which, in turn, causes back pressure to build up in line H3 which is applied to valve V1 to pilot that valve and shift it to its higher pressure relief mode. Once valve V1 has been shifted, the remaining operations of the machine take place at the higher pressure level, as described.

With solenoid valves SV2 and SV3 shifted, and after the clamp cylinder 26 has extended fully the power check valve PVC is closed to prevent reverse flow from the head end of clamp cylinder 26. The power check valve PCV is closed before the nail drive cylinder is operated. To that end, power check valve PVC is set so that it will be shiftable to its closed configuration under a piloting pressure of slightly greater than the pressure necessary to shift valve V2. Thus, after cylinder 26 extends fully and the pressure in the system begins to raise to the maximum, the pressure, through line H7 and the manual selector valve MV1 will shift valve PCV through line H8 to its closed configuration. At substantially the same time as the shifting of valve PCV to its closed configuration, valve V2 opens to admit pressure fluid into the head end of the nail driver cylinder 100. The nail driving operation continues as the nail drive cylinder raises until a switch 102 is operated by a cam 104 on the piston rod 106 of the nail driver cylinder 100. Switch X is connected, through lines E4 and E5 to the solenoid valves SV2 and SV1 to shift those valves. Shifting solenoid valve SV1 returns the pneumatic slide cylinder 56 to its raised configuration. Resetting solenoid valve SV2 effects opening of power check valve PCV and directs fluid under pressure to the rod end of each of clamp cylinder 26 and nail driver cylinder 100 while simultaneously venting their head ends. The machine thus returns to its idle configuration and the operator can remove the boot without bending it. The nails then are reloaded by the nail loading mechanism (not shown) and the machine is ready for a new cycle.

The foregoing description of the control system for the machine has illustrated operation on a boot in which the holddown mechanism is withdrawn to an upper, remote and out-of the-way position to enable the boot to be removed from the jack without interferring with that removal or with placement of a next boot on the jack. When operating on low shoes, it is desired to maintain the holddown mechanism in its lowered, and normally operating position by maintaining the air cylinder 56 in its extended position at all times. That is accomplished by manual switching of switch SW1 from the configuration shown in FIG. 8 to one in which contacts A are closed and B are open. That energizes solenoid SV1 through line E1 which shifts valve SV1 to a configuration which air under pressure is maintained on the head end of the air cylinder 56 at all times, thereby maintaining the holddown mechanism in its fully down and normal position. In that position, switch 81 is also maintained closed and the machine is ready for actuation by operating treadle switch SW3 to operate the clamp cylinder 26 and remaining operating mechanisms of the machine as in the sequence described above.

In addition to the foregoing controls, there may be some instances in which it is desired to have the clamp cylinder 26 bear downwardly against the heel under the full pressure available in the machine, and not merely under a pressure just equal to that required to resist the nailing operation. To that end, valve MV1 may be manually shifted from the configuration illustrated in FIG. 8 which will enable fluid under the full pressure of the machine to be directed to the head end of cylinder 26, through lines H3, H4, valve PCV.

It should be understood that the foregoing description of the invention intended is merely to be illustrative thereof and that other emobodiments and modifications may be apparent to those skilled in the art without departing from its spirit.

Having thus described the invention, what I desire to claim and secure by Letters Patent is:

1. In a heel attaching machine, the improvement comprising, in combination:

a stationary nailing die for supporting in a predetermined position a shoe or boot to which a heel is to be attached, said nailing die having a plurality of nail passages arranged to guide nails toward and into said shoe or boot;

nail driver means for driving nails through the passages into said shoe or boot;

a heel holddown mechanism having a heel holddown engageable with a heel thereby to provide a back-up holddown force for the heel to resist the force of nails driven into said heel by the nail driver means;

means mounting the heel holddown mechanism for movement in its entirety between an operating position in proximity to the nailing die and a remote position in which said holddown mechanism is incapable of providing said back-up hold down force;

drive means for moving the heel holddown mechanism between said operable and remote positions;

said heel holddown mechanism including a holddown member moveable toward and away from the nailing die between clamping and unclamped positions when said holddown mechanism is in said operable position;

said heel holddown mechanism including second drive means for moving said holddown member between said clamped and unclamped positions;

means for maintaining the heel holddown mechanism in its operable position at least during the holddown and nailing portion cycles of operation of the machine; and control means further comprising means for selectively causing the first drive means to return to its remote position after the nailing operation has been completed or, alternatively, to remain in its operable position.

2. A heel attaching machine as defined in claim 1 further comprising:

nail driving means; and control means for disabling operation of the nail driving means except when the heel holddown mechanism is in its operating position.

3. A machine as defined in claim 1 wherein the means for moving the mechanism between an operative and a remote position comprises fast acting pneumatic cylinder means.

4. A machine as defined in claim 1 wherein the remote position is sufficiently distant from the nailing die to enable a boot to be withdrawn from the nailing die without requiring the boot shaft to be bent or otherwise deformed.

5. A machine as defined in claim 1 further comprising:

the means for mounting the heel holddown mechanism for said movement comprises:

a slide mounted for movement between an operable position toward the nailing die and a remote position which is away from the nailing die;

the heel holddown mechanism being carried by the slide;

the drive means further comprising a pneumatic cylinder mounted to the machine and linkage means connecting the pneumatic cylinder to the slide.

6. A machine as defined in claim 5 further comprising:

means for locking the heel holddown mechanism in the operable position comprising means for locking the linkage means in that configuration which it assumes when the heel holddown mechanism is in its operable position.

7. A machine as defined in claim 6 further comprising:

means responsive to locking of said linkage in a position which will locate the heel holddown in its operable position for enabling operation of the holddown mechanism and the nail driving mechanism.

* * * * *